United States Patent [19]

Jonkers et al.

[11] Patent Number: 4,933,073

[45] Date of Patent: Jun. 12, 1990

[54] DRUM FOR SEPARATING CASTINGS AND MOLDING SAND OR THE LIKE

[76] Inventors: Cornelis O. Jonkers, Morshoekweg 5, 7552 PE Hengelo; Jan Koel, Sydwende 81, 9204 KC Drachten, both of Netherlands

[21] Appl. No.: 287,699

[22] Filed: Dec. 20, 1988

Related U.S. Application Data

[63] Continuation of Ser. No. 441,515, filed as PCT NL82/00007 on Mar. 8, 1982, published as WO82/03029 on Sep. 16, 1982, abandoned.

[30] Foreign Application Priority Data

Mar. 9, 1981 [NL] Netherlands ..... 810117

[51] Int. Cl.[5] ..... B07B 1/24

[52] U.S. Cl. ..... 209/284; 209/297; 209/294; 209/296; 209/298; 34/109; 34/128; 34/142

[58] Field of Search ..... 209/290, 294, 297, 298, 209/291, 289, 473, 482, 284, 296; 34/136, 137, 108, 142, 128, 109; 164/401, 404

[56] References Cited

U.S. PATENT DOCUMENTS

| | | | |
|---|---|---|---|
| 224,406 | 2/1880 | Duhen | 209/291 |
| 3,469,324 | 9/1969 | Vissers | 34/13 |
| 3,942,644 | 3/1976 | Vissers | 51/164.1 |
| 3,998,262 | 12/1976 | Didion | 209/297 |
| 4,151,074 | 4/1979 | Mohri | 209/482 |
| 4,154,290 | 5/1979 | Weststrate | 164/404 |
| 4,209,055 | 6/1980 | Buhler | 164/401 |
| 4,211,274 | 7/1980 | Slowinski | 164/401 |

FOREIGN PATENT DOCUMENTS

| | | |
|---|---|---|
| 2607265 | 9/1977 | Fed. Rep. of Germany . |
| 2805709 | 8/1978 | Fed. Rep. of Germany . |
| 2751500 | 9/1978 | Fed. Rep. of Germany . |
| 2167308 | 8/1973 | France . |
| 2355594 | 1/1978 | France . |
| 2374115 | 7/1978 | France . |
| 7701502 | 8/1978 | Netherlands . |

OTHER PUBLICATIONS

"Fonderie", No. 315, p. 291, 8/72.

"Rotocoolair", Pamphlet by British Ronceracy Lmtd., 1974.

*Primary Examiner*—David L. Lacey

*Assistant Examiner*—Thomas M. Lithgow

[57] ABSTRACT

A rotating drum (1) for cooling and separating castings and molding sand has a foraminous liner (27, 8). In a first part (28) thereof there are sand raising vanes (17) between this liner (27) and the closed wall (28) of the drum to raise sand, passing through the perforations in this liner part (28) to spray it over the castings. In a second, more downstream part (8) of the liner this liner part (8) intersects the theoretical sand level (13, 14) to lift the castings from the sand, so as to discharge the castings via liner part (9) and discharge edge (10) separately from the sand. The sand separated from the castings is taken up in a closed end part (5, 7) of the drum (1) having a discrete discharge edge (11) for discharging the sand at the downstream end in a narrow zone. This gives a drum with high cooling and separating capacity and efficiency with the least possible noise and dust generation.

9 Claims, 1 Drawing Sheet

DRUM FOR SEPARATING CASTINGS AND MOLDING SAND OR THE LIKE

This application is a continuation of application Ser. No. 06/441,515, filed as PCT NL82/00007 on Mar. 8, 1982, published as WO82/03829 on Sep. 16, 1982, now abandoned.

This invention relates to a drum for separating and cooling castings and molding sand or the like, with means to feed castings and sand simultaneously to one axial end of the drum and means to discharge castings and sand separately at the other end of the drum, with a foraminous liner within the drum and sand raising vanes between the liner and the closed drumwall around it, which liner extends axially over more than half the length of the drum.

Such a drum is known from the Netherlands patent specification No. 128.904. Therein the foraminous liner terminates axially in a point before the sand discharge part of the drum which in usual manner consists of a foraminous terminal part of the drumwall which is entirely closed over the remainder of its length. Sand and castings at the discharge end of said liner fall therefrom immediately into the foraminous sand discharge part thereof, from which the sand is gradually discharged through the openings and in which the castings, thus gradually liberated from sand, are moved to the discharge edge of the drum.

In such a drum a lot of noise and dust is generated. Moreover there is the necessity to take up the sand discharge from the drum over a wide zone axially of the drum, e.g. with the aid of a wide conveyor belt, and there is much wear. Such a drum should be relatively long.

It is an object of the invention to improve such a drum in the said respects and to this end the drum is according to the invention characterized in that the closed drumwall has at its axial downstream end a sand discharge edge concentrated in one short axial zone of the drum, that the closed part of liner extends without sudden change of diameter past this sand discharge edge, that the theoretical maximum sand level in the drum, determinated by the straight connecting line between the lowest point of the sand discharge opening intersects the foraminous liner part near the discharge end of the drum and that the sand raising vanes terminate in the downstream direction at a distance before the intersecting point.

The separation of sand and castings thereby takes place in the interior of the drum, gradually and within the liner, the castings moving on gradually and the dust quantity generated is small. This dust is discharged with the air flow, which is usually caused to flow through the drum and most frequently in the direction opposite to the movement of castings and sand. The noise caused by the sliding or rolling castings mainly when separated from the sand is damped considerably by the drumwall around them in this area, which damping is increased by the sand being present outside the liner in this downstream end of the drum. The sand is taken up when discharged from the drum concentrated in a narrow zone with little generation of dust only. The drum may be relatively short. The part of the foraminous liner near the discharge end being most subjected to wear may if desired easily be renewed or replaced, to which end this part may be easily detachable from the remainder of the structure of the drum.

It is remarked that a foraminous liner for separating sand and castings with a sand discharge concentrated axially in such a separating drum is known from German published application No. 2,751,500. Said liner has a considerable cone angle (about 60°) and joints the closed drumwall directly near the downstream end of the drum. This structure is intended for allowing the sand to pass through the preforations of said liner in a condition in which it is still somewhat humid and is taken up in a widened sand take-up part of the drum rotating therewith, from which it flows through openings in a wall perpendicular to the drum axis to a stationary sand take-up casing, in which flow it is aided by a strong airflow which cools the sand further while using the heat of evaporation of the moisture still present therein.

When applying the invention it is possible to dry the sand already in a more upstream zone of the drum to such an extent that if flows easily in both directions through the foraminous liner, even with the same drum length, so that the sand is easily taken upwards by the sand raising vanes to be sprayed (to rain) over the castings. By choosing the space between liner and closed drumwall around it sufficiently wide it is thus possible to spray sand over the castings over substantially the entire horizontal inner space of the drum, and on the other hand, by not making this space too wide, the castings remain sufficiently embedded in sand and it is thereby more easy to obtain an optimum effect and mutual adjustment as to cooling of the castings and cooling and drying of the sand.

Preferably the liner at the upstream end joins without sudden change of diameter a closed drum part upstream thereof, in which closed drum part castings and sand remain in intimate contact for a uniform cooling of the castings by the sand and a beginning of the drying of the sand, which allows introduction of the castings into the drum at a very high temperature and which considerably limits wear of the liner.

The invention will now be explained in more detail with reference to the enclosed drawings which by way of example and somewhat diagrammatically show a drum according to the invention in different possibilities of embodiment. In said drawings.

Figure 1:
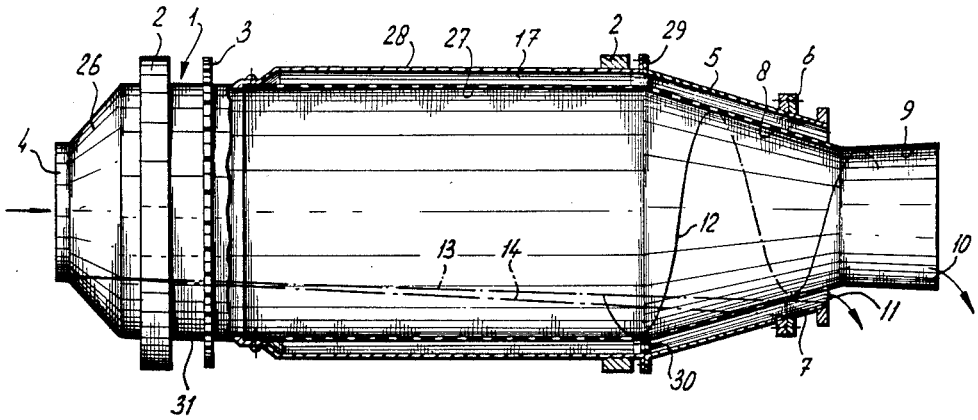
FIG. 1 is an axial section through and partially an elevation of a drum according to the invention in a first embodiment.

In FIG. 1 it is diagrammatically shown how a drum 1 has riding rings 2, by which it is supported in usual and wellknown manner in a frame not shown on rollers, said drum moreover having a toothed ring 3 for being rotated by engagement of said ring with a pinion not shown, driven e.g. by an electric motor to rotate the drum about its horizontal or almost horizontal axis.

At the left end in FIG. 1 the drum has a feed opening 4 for sand and castings. Near this opening 4 the drum has a conically widening inlet part 26. The closed cylindrical drum part 31 changes without change of diameter in a foraminous cylindrical linner 27 joining at the discharge end directly the conically narrowing foraminous part 8, which joins the closed part 9 for discharging the castings over the discharge edge 10. Around the foraminous part 27 there is a closed drum part 28 which at its downstream end is connected rigidly by a flange connection 29 to the conically narrowing closed drum part 5 which terminates in a sand discharge edge 11. Between the cylindrical foraminous part 27 and the conical foraminous part 8 there may also be a detachable flange connection as indicated by 30, which connection has openings to allow sand to pass. In the space between the cylindrical parts 27 and 28 sand raising vanes 17 are provided. These may be simple strips of metal in radial position entirely or almost entirely bridging the space between the parts 27 and 28 and which may extend in the longitudinal direction parallel to the axis of the drum. The space between the parts 27 and 28 takes up sand, which thereupon is discharged gradually to the inner space within the foraminous part 27 on rotation of the drum to be sprayed over the castings. The theoretical sand level 13, determined by a straight connecting line between the lower point of opening 4 and the lower point of sand discharge edge 11 intersects the conically narrowing foraminous liner 8, so that in this area a separation between sand and castings takes place, so that the castings, if necessary with the aid of one or more helical strips or other parts protruding into the drum indicated by 12 and known as such, are moved upwardly from the bed of sand to reach the discharged edge 10 therefor via part 9.

If the liner 8 has to be replaced it is possible to loosen the flange connections 29 and 30 to introduce a new liner 8. If wear takes place only in the more downstream part of the liner 8 it would be possible to position the flange connection 30 more to the downstream end, in which case the cylindrical foraminous part 27 of the liner may be rigidly connected to the first, upstream part of the conical liner 8.

If the cylindrical foraminous liner 27 has to be replaced, it is possible to detach this from the outside at the junction of the closed drum parts 31 and 28, after which they may be moved axially away from each other. It would also be possible to manufacture and assemble the closed drum part 28 as a separate and separately detachable part to replace it by a part of another diameter, e.g. if the device has to operate with another proportion between quantity of sand and volume of the castings. Said part 28 may e.g. be built up of two semi-cylindrical halves to be connected by e.g. a flange connection in a plane through the axis of the drum. It is possible of course to mount the riding rings 2 on other parts of the drum. The right hand ring 2 may e.g. be provided on the conical part 5 of the drum, which may have the advantage of the smaller diameter thus possible. All such details are chosen depending on questions of wear, frequency of replacement etc.

Below the discharge edges 10 and 11 suitable conveying means such as belts may be provided for taking up sand and castings respectively.

If it is desired to lower the sand level in the drum, e.g. if it is desired to have a great quantity of sand pass the drum rapidly, e.g. after a period of inactivity, in which sand and castings have been cooling in the drum, or if molds which have had time to cool somewhere else for some reason have to be emptied and sand and castings therein have to be separated without cooling, it is possible to lower the sand discharge edge of the drum temporarily, e.g. by dividing the conical part 5 so that it has a separate part 7 connected by an easily detachable flange connection 6 to the remainder thereof. In that case the theoretical maximum sand level in the drum is indicated by dot-and-dash-line 14.

Of course the lines 13 and 14 do not show real sand levels. The sand level will tend to have a small inclination of e.g. one to several degrees with respect to the horizontal and at the feed end near opening 4 the sand will usually be at a lower level, but for characterizing this device such theoretical sand levels are easily applicable criteria. Always such lines have to intersect the foraminous liner as indicated to give a good separation of sand and castings.

It would be possible to make drum part 28 slightly conical instead of cylindrical and it is possible to position the axis of the drum with some deviation to the horizontal, but usually this will not be necessary if only the sand discharge edge 11 in its lowest point is lower than the lowest point of the feed opening 4, so that there will always be a sand flow towards the discharge end.

The cooling, feeding and evaporation of water and exchange of heat between castings and sand in the cylindrical drum part 1 will not have to be described in detail as this does not differ in essence from what happens in known drums for cooling sand and castings.

Figure 2:
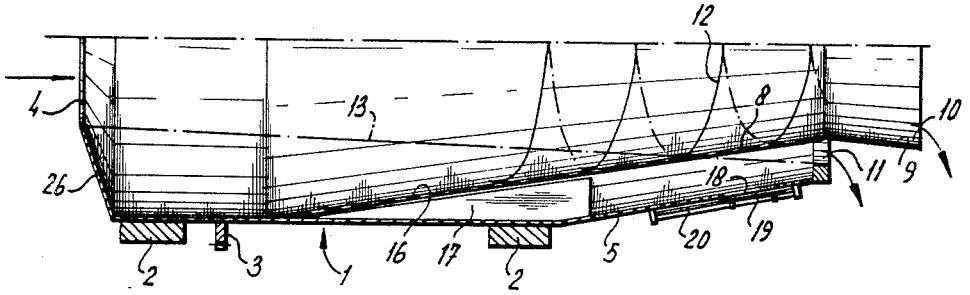
FIG. 2 is an axial section through the lower half of a drum according to the invention in a second embodiment.

In FIG. 2 a foraminous liner 8 is shown extending over more than half of the length of the drum and having a part 16 joining at the upstream end the closed inner wall of the drum. Between this part 16 and the cylindrical drum wall 1 there are sand raising vanes 17, raising the sand on rotation of the durm to spray it over the castings in this part 16. The closed conical part 5 of the drum wall has an opening 18 which may be closed by a slide valve 19 guidable to and fro in guides 20 between an open and a closed position, allowing at the beginning of or after a period of stagnation or standstill to discharge a considerable quantity of sand from the drum. It is possible to leave opening 18 open during some time while rotating the drum until the desired quantity of sand has been discharged.

Figure 3:
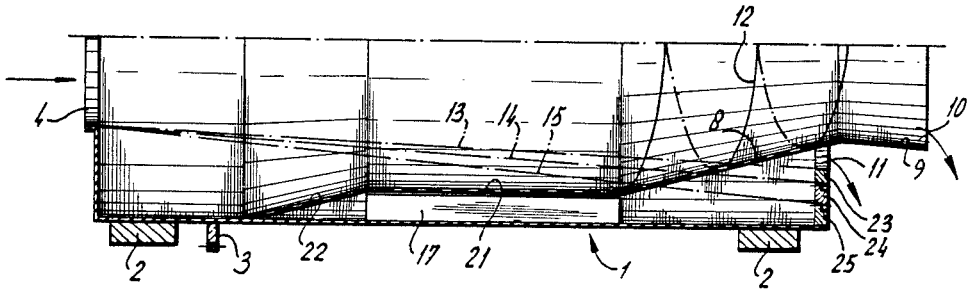
FIG. 3 is an axial section of the lower half of the drum in a third embodiment.

It FIG. 3 it is shown that the foraminous liner 8 at its upstream end joins a cylindrical foraminous liner part 21 with sand raising vanes 17 between that part 21 and the closed wall of the drum. This cylindrical part 21 joins towards the feed end of the drum a conical part 22 having about the same cone angle as part 8 and which may or may not be foraminous. It joins the closed wall of the drum at the upstream end without sudden change of diameter. Preferably it is foraminous.

By this part 22 there is, in the same way as by the upstream end of the liner in part 16 of FIG. 2, an additional resistance for the flow of castings and sand to the discharge end, so that for certain compositions and dimensions of the sand and for certain castings such as small somewhat spherical castings there is a kind of milling action to avoid the foraminous of clods or lumps in the sand, which milling action is better if part 22 be foraminous. The closed drum 1 is cylindrical over its entire length and terminates in the concentrated sand discharge edge 11 formed by the inner edge of a set of rings, in this case three rings 23, 24 and 25. Ring 25 is rigidly or detachably connected to the inner wall of the drum and within ring 25 there are the other rings 23 and 24 concentric with and detachable from the drum and from each other. It is thus possible to vary the theoretical sand level between the indicated lines 13, 14 and 15.

The sand space between liner and drum in the area of the sand raising vanes 17 in FIG. 2 and in the space around the foraminous liner 8 in FIG. 3 widens in the downstream direction and this has the advantage that, if e.g. accidentally too much water is supplied to the drum, the sand runs less risk to form a coherent cake. It is possible to make the sand space between liner and drum widening downstream over the entire length, e.g. by giving parts of the drum a smaller cone angle than parts of the liner immediately within such drum parts.

The sand raising vanes 17 may, as stated, be radial and extending in longitudinal direction parallel to the axis of the drum. They may however be inclined with respect to the radial direction to shovel up more sand and, in longitudinal direction, they may extend along helical lines to push the sand more towards the discharge end of the drum, but in most cases this is not necessary. It is sufficient to connect such vanes to one wall only, to the inner wall of the drum or to the outer wall of the liner, e.g. by welding.

The conical parts of the liner have a cone angle which is substantially smaller than 45°, preferably about 35°. This relates to the full cone angle, not to the angle with respect to the axis. The space between the liner and the closed drum wall around it, at least over the greater axial part of the area of the sand raising veins, has a dimension in radial direction of at least 10 cm and at most 30 cm, or has a radial dimension between 1/10 and 1/30 of the inner diameter of the liner in the same plane perpendicular to the axis of the drum.

We claim:

1. A rotary tubular drum for separating and cooling castings and molding sand, said drum having a longitudinal centerline and a drum wall substantially a conical part becoming narrower towards the discharge end of closed over the axial length thereof and extending substantially horizontally, means connected to said drum for rotating the same about said centerline, a feed opening means at one axial end of said drum for receiving castings and sand and having a low point at a first radial location with respect to said longitudinal centerline, means for discharging castings and sand separately at the other axial end of the drum, a liner having a foraminous liner part within the drum, said liner part being connected to and merging gradually and without abrupt change of diameter into the closed drum wall at a distance axially remote from said one axial end, said foraminous liner part extending axially toward said other axial end of the drum over more than half the length of the drum, sand raising vanes between the foraminous liner part and the closed drumwall around said liner part, said sand raising vanes extending over part of the length of the liner part, said means for discharging sand comprising an axial downstream end of said closed drumwall including a sand discharge edge concentrated in one short axial zone of the drum and having a low point at a second radial location with respect to said longitudinal centerline, the foraminous liner part decreasing in diameter downstream of said sand raising vanes axially upstream of and up to said sand discharge edge, the liner extending past said sand discharge edge and terminating at a third radial location with respect to said longitudinal centerline and forming said means for discharging castings from the drum, the theoretical maximum sand level in the drum being determined by a straight connecting line between the first radial location and the second radial location, said second radial location being farther from said longitudinal centerline than said first radial location, the straight line intersecting the foraminous liner part at a point before the sand discharge edge so that essentially all of the sand moving through the drum passes through said foraminous liner part before reaching the other axial end of the drum, and the sand raising vanes terminating in the downstream direction at a distance before the intersecting point.

2. A drum according to claim 1, wherein said foraminous liner part at the upstream end has a first conical part becoming narrower in the downstream direction from a point of contact with the cylindrical drumwall and joining a cylindrical part of the foraminous liner part, along the outside of said cylindrical part said sand raising vanes being provided, said cylindrical part at its discharge end joining a conical part becoming narrower towards the discharge end of the drumwall for separating sand and castings, the drumwall being cylindrical around said first conical part and around said part with sand raising vanes.

3. A drum according to claim 1, wherein the foraminous liner part in the zone of the sand raising vanes is cylindrical and directly joins the cylindrical closed drumwall upstream thereof having the same diameter.

4. A drum according to claim 1, wherein the space between the liner end the closed drum wall around it, at least over the greater axial part of the area of the sand raising vanes, has a dimension in radial direction of at least 10 cm and at the most 30 cm.

5. A drum according to claim 4, wherein said space has a radial dimension between 1/10 and 1/30 of the inner diameter of the liner in the same plane perpendicular to the axis of the drum.

6. A drum according to claim 1, wherein the foraminous liner part is conical over its entire length up to the axial zone of the sand discharge edge, and wherein the closed drumwall around the foraminous liner part is conical at least over the greater part of the length of the sand raising vanes, with the conical part having a cone angle smaller than the cone angle of the foraminous liner part.

7. A drum according to claim 1, wherein the foraminous liner part is conical over its entire length up to the axial zone of the sand discharge edge and wherein the closed drumwall around the foraminous liner part is cylindrical over at least the greater part of the axial zone over which the sand raising vanes extend, the sand raising vanes increasing in radial dimension axially towards the sand discharge edge.

8. A drum according to claim 1, wherein the conical foraminous liner part has to total cone angle smaller than 45°.

9. A drum according to any one of claims 1 7, 8, 2, 3, 4, 5 or 6, wherein the closed drum wall has removable parts for varying the diameter of the

* * * * *